US007287986B2

(12) United States Patent
Ho

(10) Patent No.: US 7,287,986 B2
(45) Date of Patent: Oct. 30, 2007

(54) ELECTRICAL CONNECTOR

(75) Inventor: Yi-Tse Ho, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/472,861

(22) Filed: Jun. 22, 2006

(65) Prior Publication Data

US 2007/0020961 A1 Jan. 25, 2007

(30) Foreign Application Priority Data

Jul. 20, 2005 (TW) ..... 94212275 U

(51) Int. Cl.
*H01R 12/00* (2006.01)

(52) U.S. Cl. ..... 439/65; 439/862

(58) Field of Classification Search ..... 439/65, 439/862

See application file for complete search history.

(56) References Cited

U.S. PATENT DOCUMENTS 6,315,621 B1 * 11/2001 Natori et al. ..... 439/862
6,875,049 B2 * 4/2005 Kyowski et al. ..... 439/500
6,994,566 B2 * 2/2006 You ..... 439/66
6,994,576 B2 * 2/2006 Tanaka et al. ..... 439/188
7,090,546 B2 * 8/2006 Zheng et al. ..... 439/862
7,115,005 B2 * 10/2006 Zhu et al. ..... 439/862

* cited by examiner

*Primary Examiner*—Thanh-Tam Le
(74) *Attorney, Agent, or Firm*—Charles S. Cohen

(57) ABSTRACT

An electrical connector for electrically connecting a motherboard with a control circuit board and includes an insulation housing and plurality of terminals. The front face and the rear face of the insulation housing have plurality of terminal insertion slots mounted therebetween. An upper edge, near the front face of the terminal insertion slots, has a blocking portion. Each terminal has a fixing portion, a solder portion, an elastic arm, and a contacting portion. The terminals are fixed in the insulation housing by the fixing portion. The solder portions of the terminals extend beyond the rear face of the insulation housing. The upper edge of the elastic arms of the terminals engage the lower edge of the blocking portions. The elastic arms and the contacting portions of the terminals extend beyond the front face of the insulation housing with the elastic arms being located at an angle to the mounting surface of the insulation housing.

14 Claims, 7 Drawing Sheets

ELECTRICAL CONNECTOR

BACKGROUND OF THE INVENTION

1. Field of the Invention

The present invention is related to an electrical connector, and more particularly to a connector used for electrically connecting a motherboard of a printer with a control circuit board of an ink cartridge so as to facilitate a signal transmission between the motherboard and the ink cartridge.

2. Description of Related Art

Ink jet printers are the most popular printers on the market because of the low price and the colorful printing effect which are very suitable for personal and home use. All the ink jet printers have one or more ink cartridges which include a control circuit board mounted at the outer edge of the housing thereof. The control circuit board requires a proper electrical connecting device to electrically connect the cartridge to the motherboard of the printer for facilitating a signal transmission between the motherboard and the ink cartridge so as to control the nozzle of the ink cartridge.

SUMMARY OF THE INVENTION

The object of the present invention is to provide an electrical connector which can be engaged by an ink cartridge control board which is slid into position with an up to down and side to side movements in relation to the electrical connecting points on the control circuit board.

For achieving the objects described above, the present invention provides an electrical connector for electrically connecting a motherboard with a control circuit board. The control circuit board, which is installed with an ink reservoir into the printer along an arc track from up to down, includes a plurality of electrical connecting points. The electrical connector, which electrically engages the control circuit board, includes an insulation housing having a front face, a rear face, a mounting surface, and a plurality of terminal insertion slots located in and through the front face and the rear face. A blocking portion is positioned at an upper edge of the terminal insertion slots near the front face. A plurality or terminals are held in the insulation housing, each of which has a fixing portion, a solder portion at one end of the fixing portion and an elastic arm, at the other end of the fixing portion, extending forwardly, the elastic arm having a contacting portion. The terminals are fixed in the insulation housing by the fixing portion inserted in the terminal insertion slots of the insulation housing. The solder portions of the terminals extend beyond the rear face of the insulation housing. The upper edges of the elastic arms of the terminals are engaged by the lower edges of the blocking portions. The elastic arms and the contacting portions of the terminals extend beyond the front face of the insulation housing. The elastic arms of the terminals are positioned at an angle to the base surface of the insulation housing for guiding the ink cartridge control circuit board and for laterally contacting the contacting portion of each terminals with each electrical connecting points of the ink cartridge control circuit board, respectively.

The blocking portion can be used to position and to pre-load the elastic arms and to maintain the contacting portions of the terminals at an identical height. Because the elastic arms of the terminals are located at the exterior of insulation housing at an angle to the bottom mounting portion, they easily cooperate with an installing track of the ink cartridge to guide the control circuit board so that the contact portions of the terminals can make smooth contact with the control circuit board.

BRIEF DESCRIPTION OF THE DRAWINGS

The foregoing aspects and many of the attendant advantages of this invention will be more readily appreciated as the invention becomes better understood by reference to the following detailed description, when taken in conjunction with the accompanying drawings, wherein.

DETAILED DESCRIPTION OF PREFERRED EMBODIMENTS

Figure 1:
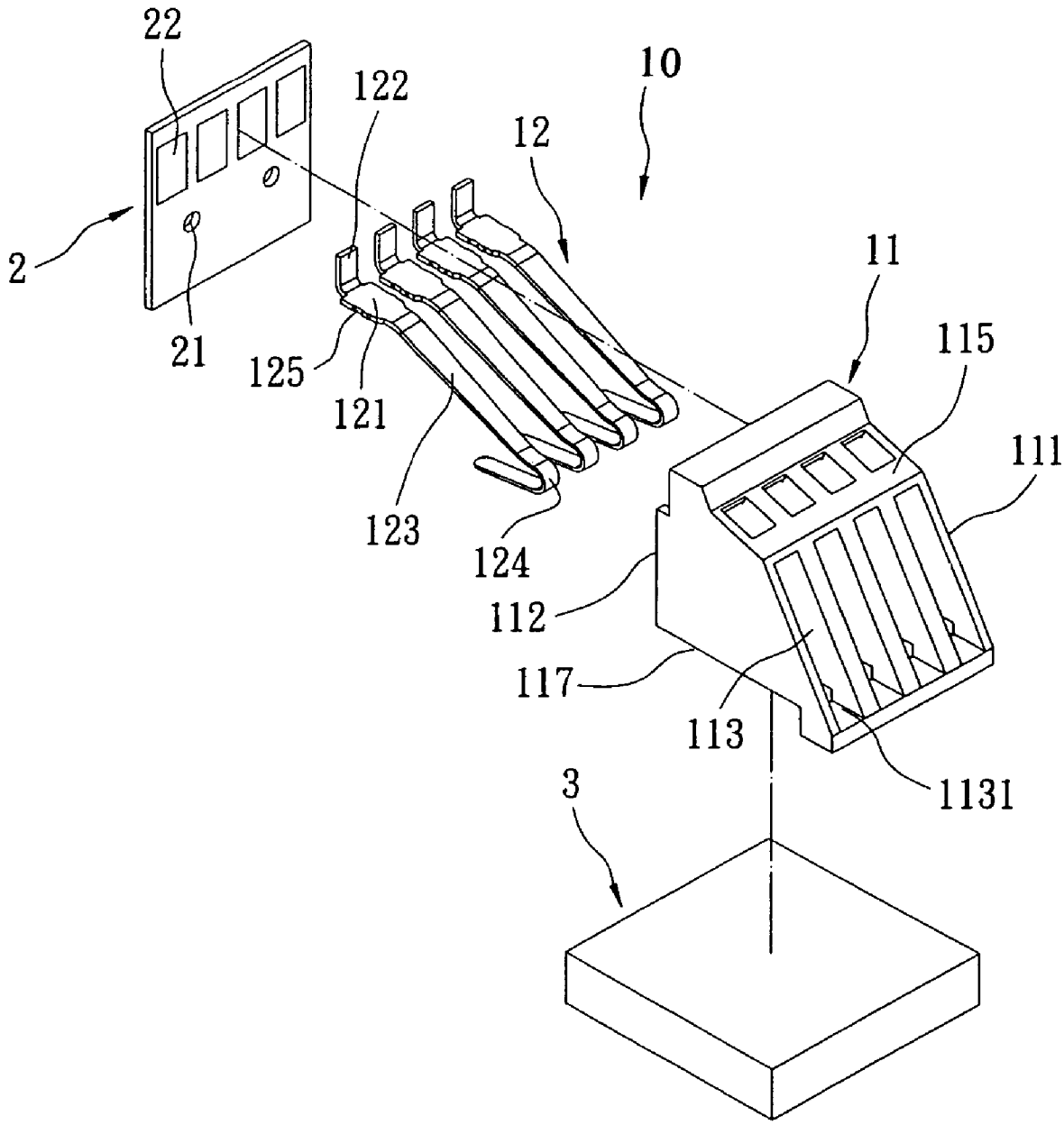
FIG. 1 is a three-dimensional exploded view showing the electrical connector housing, the flexible printed circuit board, and the frame of the printer.
Figure 2:
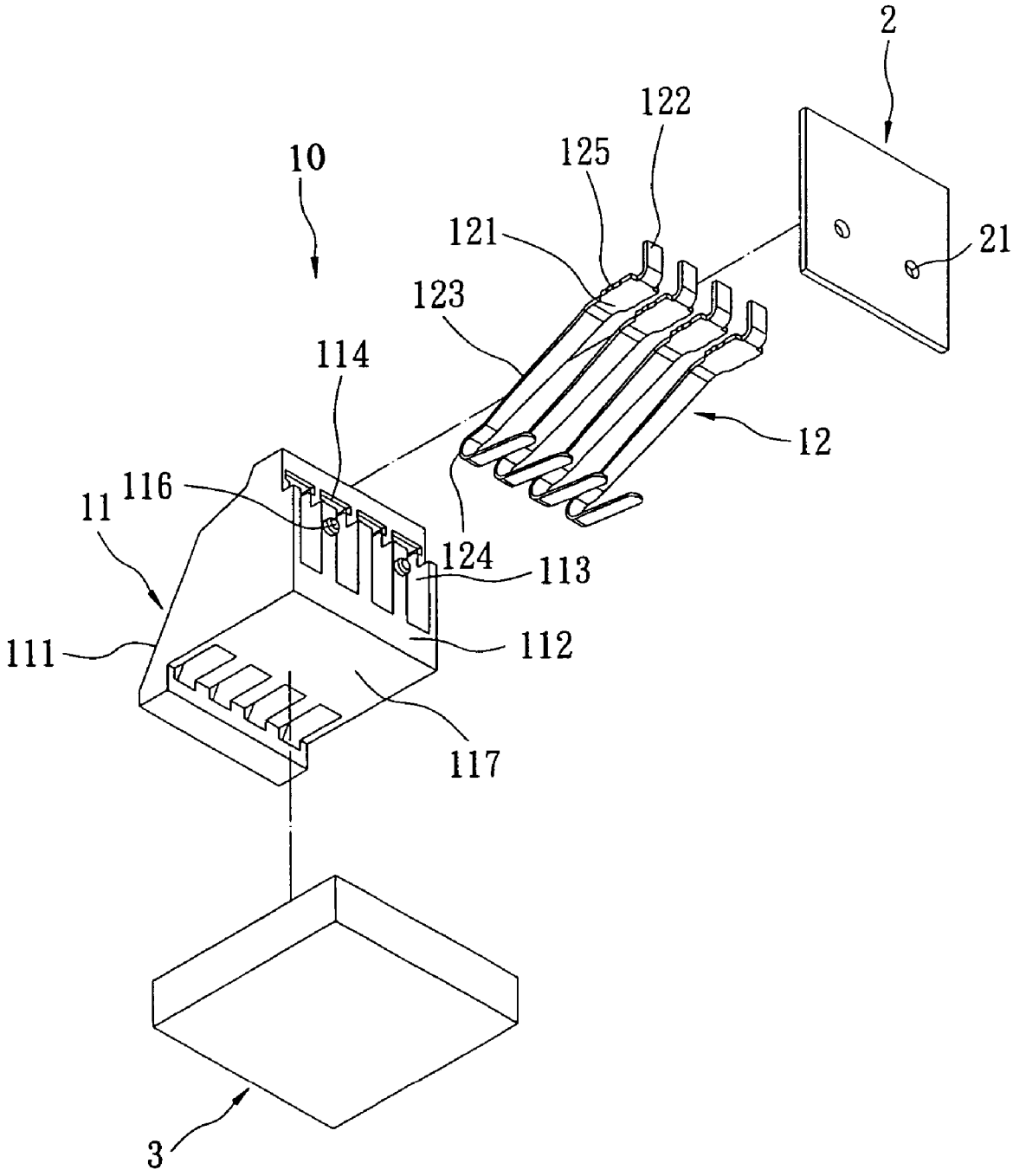
FIG. 2 is another three-dimensional exploded view from angle different from the angle in FIG. 1 showing the electrical connector housing, the flexible printed circuit board, and the frame of printer.
Figure 3:
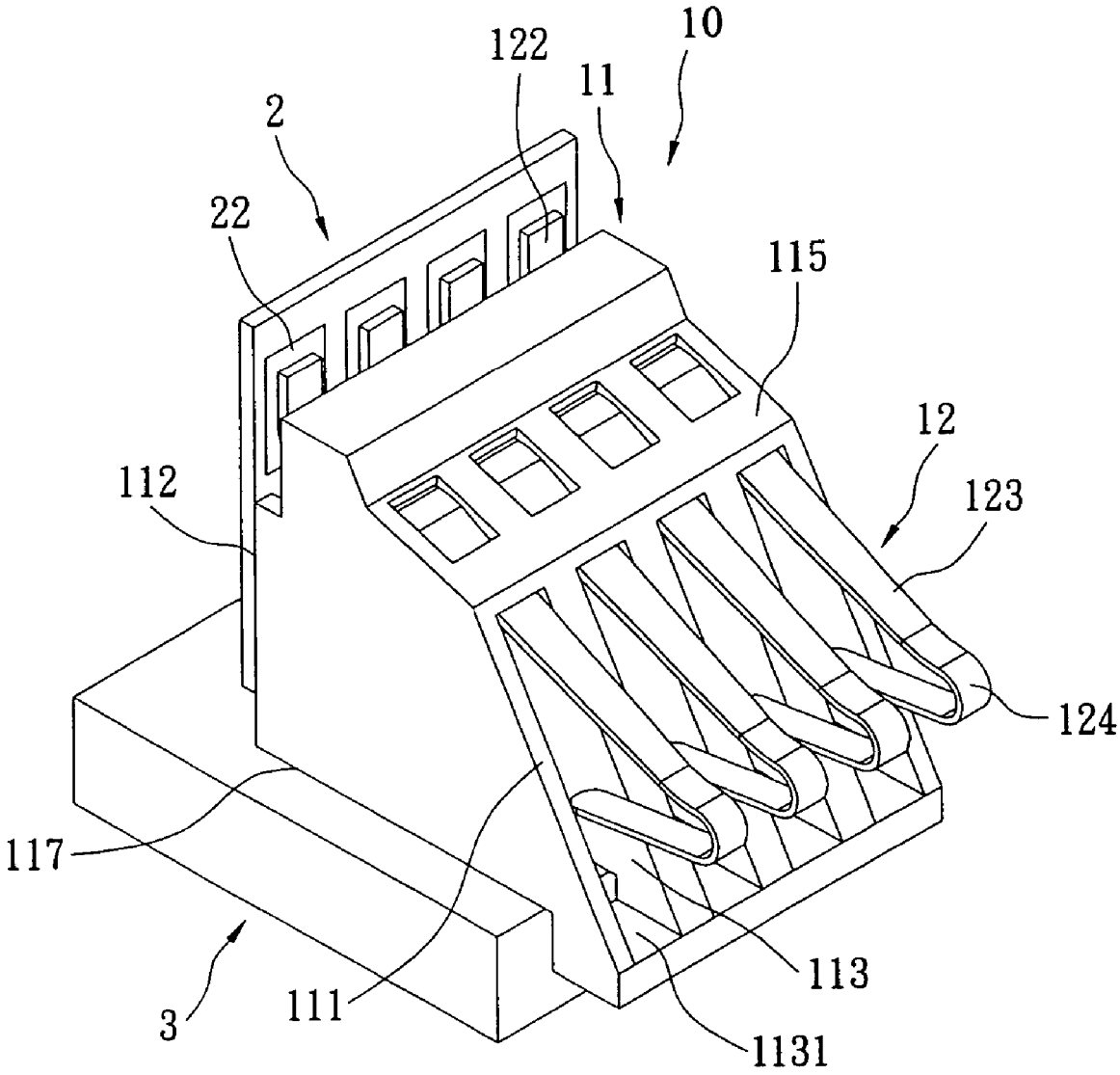
FIG. 3 is a three-dimensional assembled view showing the electrical connector housing, the flexible printed circuit board, and the frame of printer.
Figure 4:
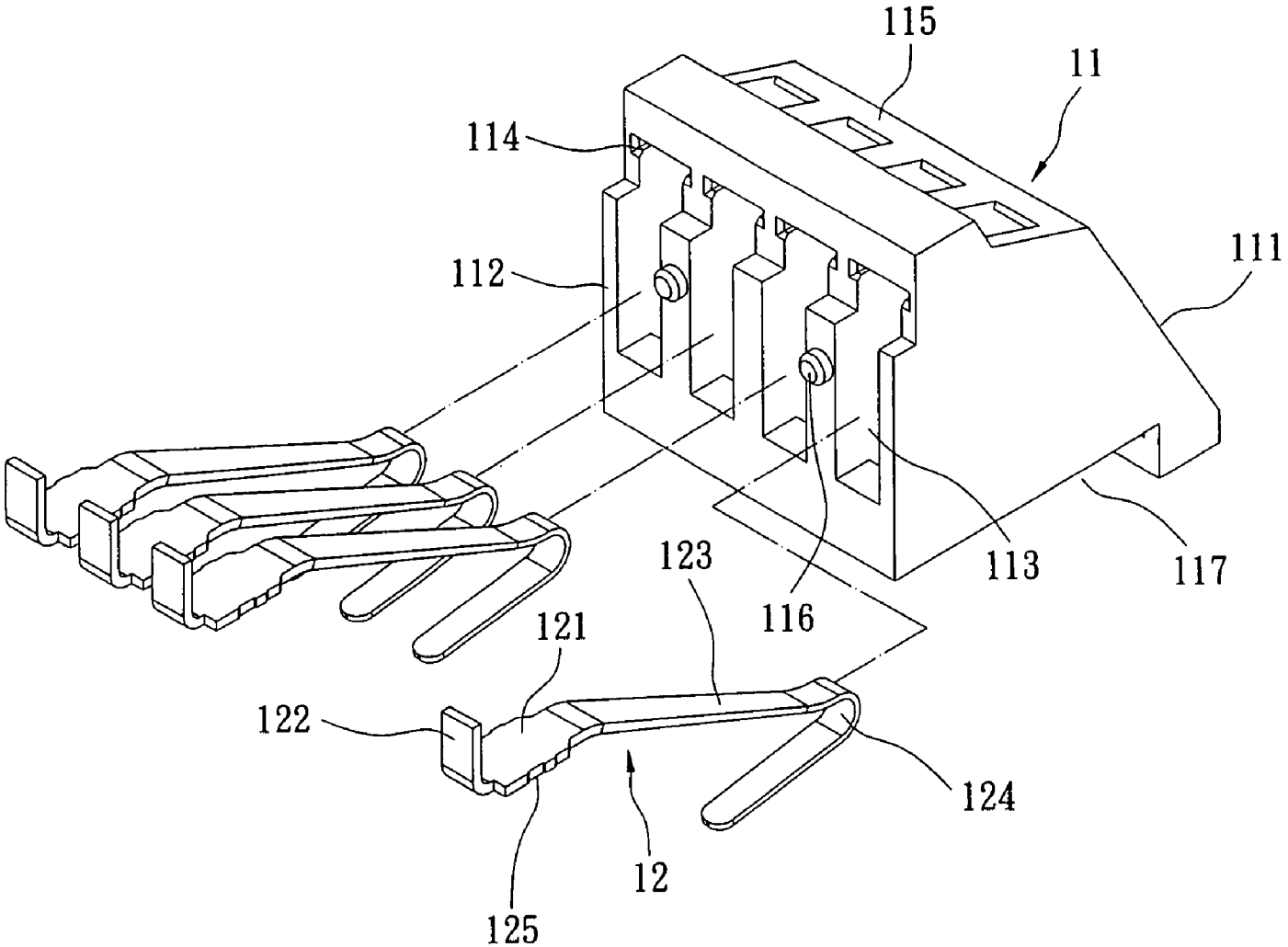
FIG. 4 is a three-dimensional exploded view showing the electrical connector housing with terminals in position just prior to being inserted into the housing.
Figure 5:
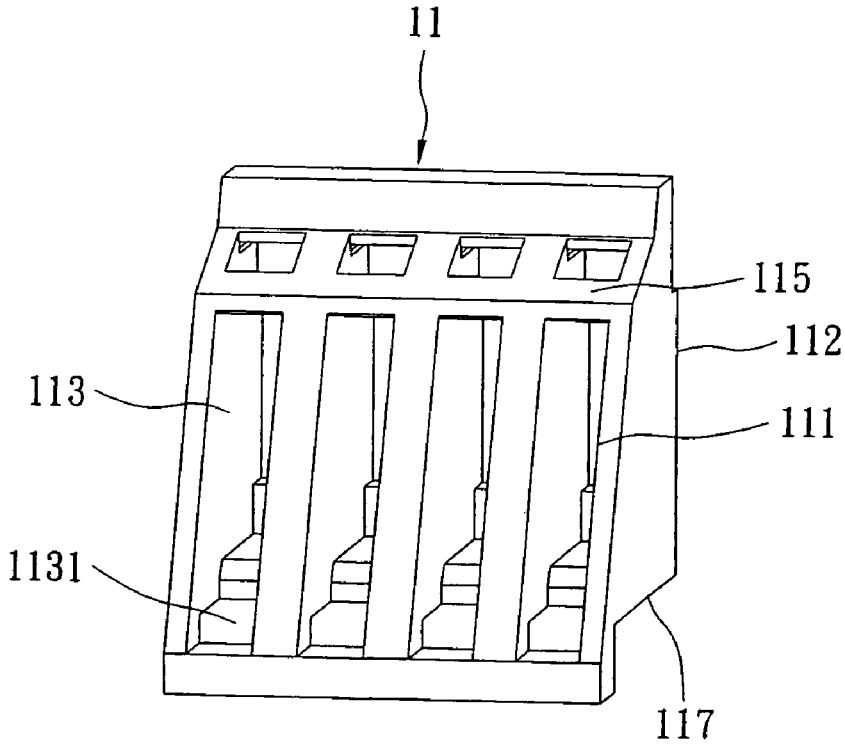
FIG. 5 is a three-dimensional view showing the insulation housing without terminals.
Figure 6:
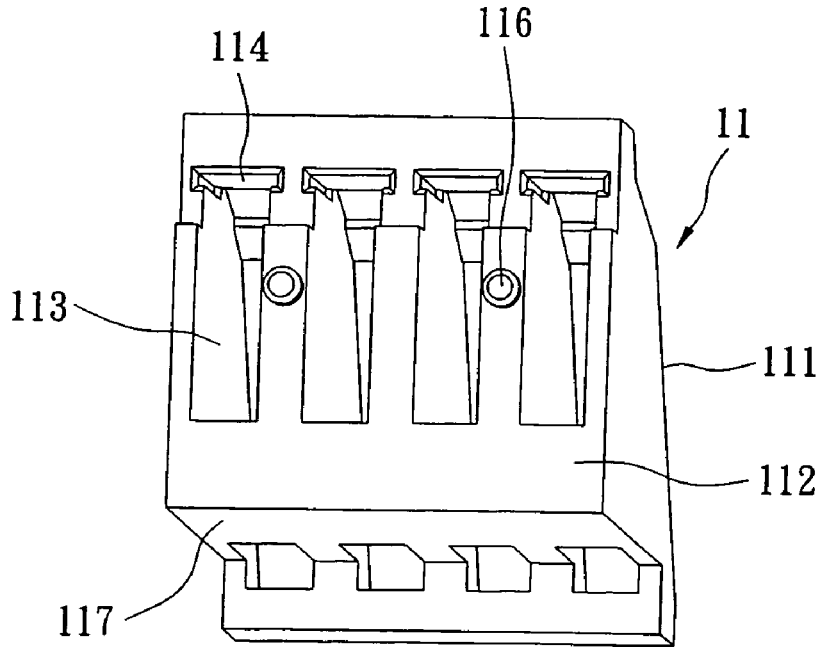
FIG. 6 is a three-dimensional view at an angle different from the angle in FIG. 5, showing the insulation housing without terminals.

The present invention, which is disclosed in FIGS. 1 to 6, provides an electrical connector, and more particularly a connector used for electrically connecting a motherboard of a printer with a control circuit board of an ink cartridge so as to facilitate a signal transmission between the motherboard and the ink cartridge. The electrical connector 10 includes an insulation housing 11 and plurality of terminals 12, wherein the insulation housing 11 is made of plastic and has a general trapezoidal shape. The insulation housing 11 has a front face 111, a rear face 112, an indentation 117 forming a mounting surface, and a plurality of terminal insertion slots 113 located adjacent each other between the front face 111 and the rear face 112 of the insulation housing 11. The two ends of the terminal insertion slots 13 are open in and extend between the front face 111 and the rear face 112. The lower edges of the terminal insertion slots 113 extend downwardly to form an accommodating space 1131.

The upper edges, near the rear face 112, of each of the terminal insertion slots 113 have a T-shaped position-limiting slot 114 for holding the terminals 12 in the insulation housing 11. The upper edge of each the terminal insertion slot 113 has a blocking portion 115 near the front face 111. This forms a rib which is transversely mounted at the upper edge of each the terminal insertion slot 113 and can be used to block and position each the terminal 12 and provides the proper pre-loading force to each terminal 12.

The rear face 112 of the insulation housing 11 further has two positioning projections 116 mounted thereon. The two positioning projections 116 correspond to two positioning holes 21, which are formed in one end of the flexible printed circuit board 2 on the motherboard of the printer. The two positioning projections 116 and the two positioning holes 21 cooperate so that one end of the flexible printed circuit board 2 can be fixed on the rear face 112 of the insulation housing 11 and thus achieve an electrical connection with the terminals 12.

The insulation housing 11 can be installed on a frame 3 of the printer. The insulation housing 11 further has an indentation 117 located at the bottom mounting surface thereof so that the bottom mounting surface of the insulation housing 11 may form a locating notch. The insulation housing 11 can be installed on the frame 3 by the indentation 117 to help locate the insulation housing on the frame and to help reduce the height of the insulation housing 11 above the frame 3.

The terminals 12 are made of a flexible conductive metal material each of which has a fixing portion 121. One end of the fixing portion 121 is connected to an upwardly extending solder portion 122, which is approximately perpendicular to the fixing portion 121. The other end of the fixing portion 121 is connected to a forwardly extending elastic arm 123, which is further connected to a bent contacting portion 124.

The terminals 12 are held in the position-limiting slots 114 of the insulation housing 11. The fixing portions 121 have an interfering portion 125 on each side of the fixing portion 121 generating an interference fit between the interfering portions 125 and the inner walls of the position-limiting slots 114. The solder portions 122 of the terminals 12 extend outside the rear face 112 of the insulation housing 11 and can be soldered to one end of the flexible printed circuit board 2 so as to achieve an electrical connection between the terminals 12 and the flexible printed circuit board 2.

Figure 7:
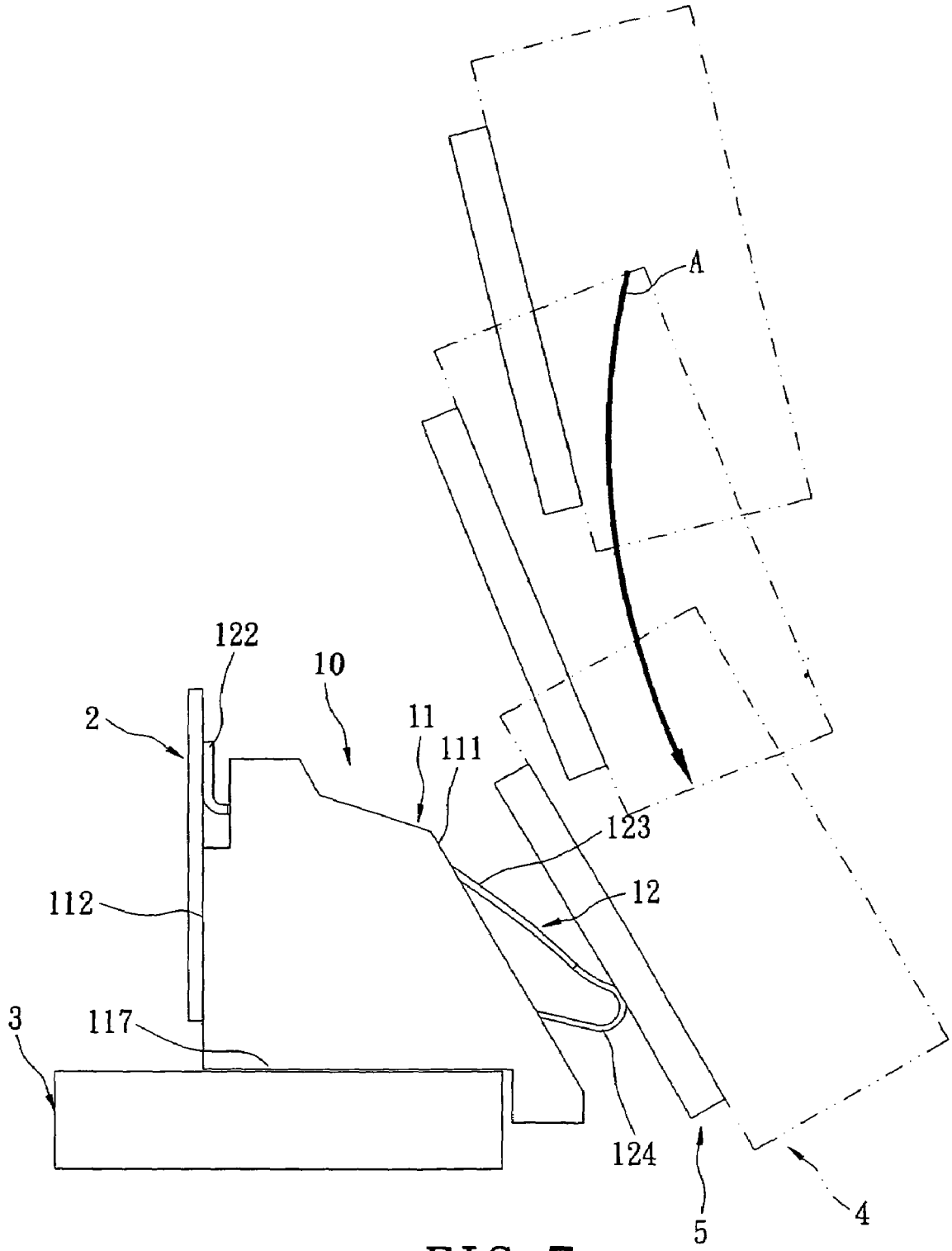
FIG. 7 is a side view showing the movement of the control circuit board of the ink cartridge as it engages the terminals of the electrical connector.
Figure 8:
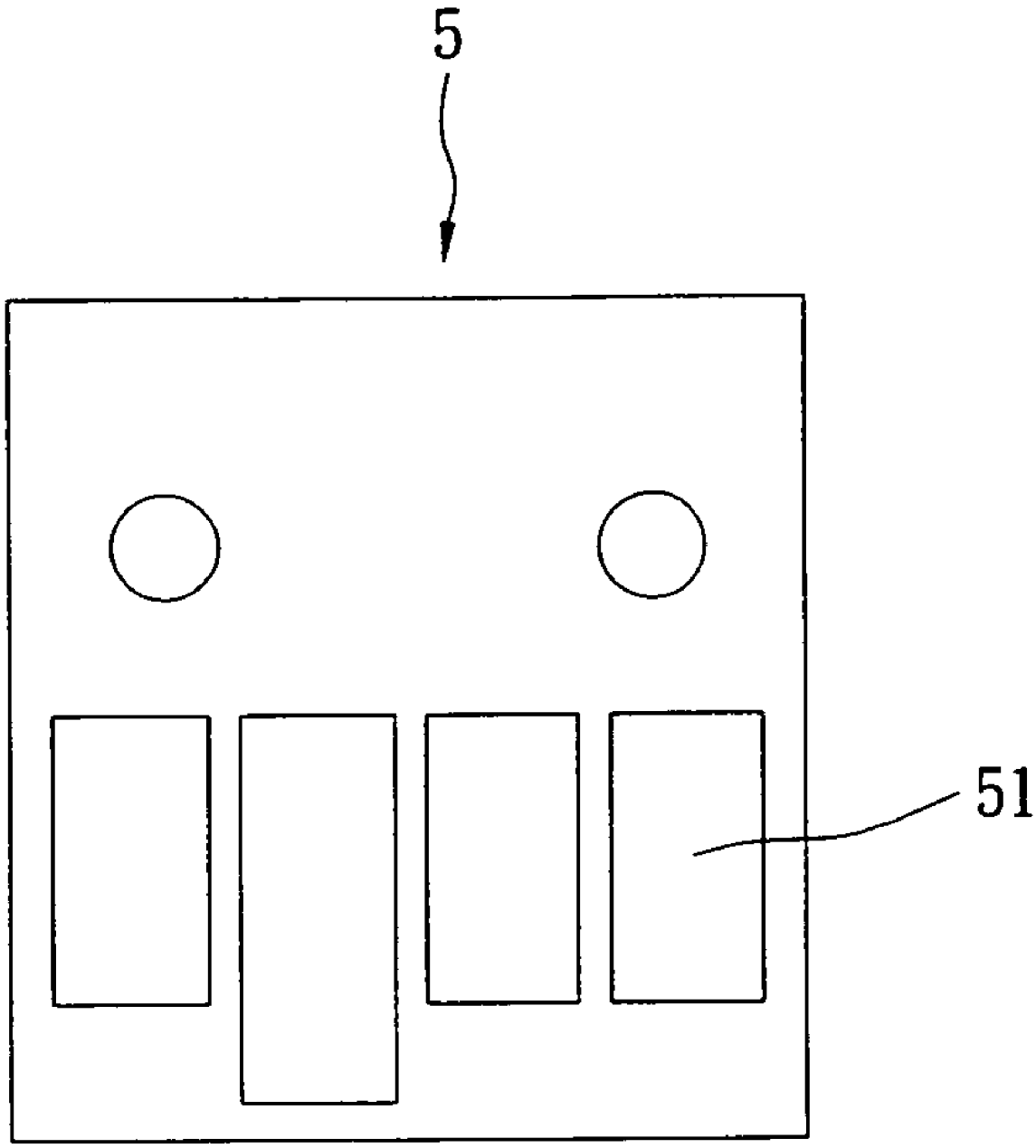
FIG. 8 is a plan view showing the ink cartridge control circuit board.

The upper edges of the elastic arms 123 on the terminals are forced into contact with the lower edge of the blocking portion 115 so that the blocking portion 115 can position the elastic arms 123, can ensure that the contacting portions 124 of the terminals 12 can be maintained at an identical height, and can ensure that a proper pre-stressing force is placed on the elastic arms 123. As shown in FIG. 7, the ink cartridge 4 is installed into the printer along an arc track A. One side of the outer edge of the ink cartridge 4 has a control circuit board 5 mounted thereon. When the control circuit board 5, together with the ink cartridge 4, is moved downwardly, the control circuit 5 engages the elastic arms 123 of the terminals 12 in a sliding direction. The elastic arms 123 of the terminals have an inclined shape for matching the arc track A of the ink cartridge 4. This inclined shape helps to guide the ink cartridge control circuit board 5, and to smoothly contact the contacting portion 124 of each the terminals 12 with each electrical connecting point 51 of the ink cartridge control circuit board 5, respectively (as shown in FIG. 8). This will ensure a greater contact surface between the terminals 12 and the control circuit board 5 so as to provide a better electrical connection between the ink cartridge 4 and the motherboard. In its final loaded position, the control circuit board 5 can achieve an electrical connection with the motherboard of the printer through the electrical connector 10 and the flexible circuit board 2 so as to facilitate the signal transmission between the motherboard and the ink cartridge.

The accommodating spaces 1131 in the terminal insertion slots 113 will allow space for the contact portions 124 to move in the event the contact pressure on the terminals is large. This will prevent the contact portions 124 from interfering with the insulation housing 11 thereby avoiding damage to the control circuit board 5 and the terminals 12.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically connecting a motherboard with a circuit board, the electrical connector comprising:

an insulative housing having a front face and a rear face, a mounting surface for mounting the housing to a frame, a plurality of terminal insertion slots opening in and extending between the front face and the rear face and a blocking portion positioned proximate said front face at an upper edge of the terminal insertion slots, said housing including an indentation disposed therein for locating said housing on said frame and for reducing a height of said housing above said frame; and a plurality of terminals, each terminal having a fixing portion, a solder portion connected to one end of the fixing portion and a forwardly extending elastic arm connected to the other end, the elastic arm being connected to a contacting portion, the terminals being held in said terminal insertion slots in said housing, the solder portion protruding out of the said rear face of the insulation housing, an upper surface of the elastic arms of said terminals in engagement with a lower edge of the blocking portions, the elastic arms and the contacting portions of said terminals extending out of the front face of said housing at an angle to the mounting surface of said housing for guiding the circuit board and for slidingly contacting the contacting portion of each said terminals with each electrical connecting point of said circuit board, respectively.

2. The electrical connector as claimed in claim 1, wherein said front face of said housing is at an angle to the mounting surface of said housing.

3. The electrical connector as claimed in claim 1, wherein lower edges of the terminal insertion slots form accommodating spaces which are positioned under the contacting portions of the elastic arms of said terminals.

4. The electrical connector as claimed in claim 1, wherein the blocking portion is a rib transversely positioned at the upper edges of said terminal insertion slots.

5. The electrical connector as claimed in claim 1, wherein the upper edge of each said terminal insertion slots has a position limiting slot mounted at said rear face thereof for holding each said terminal in said housing by the fixing portion.

6. The electrical connector as claimed in claim 5, wherein each of said terminals further has interfering portions mounted at two sides of each of the fixing portion for producing an interference fit with the inner walls of the position limiting slot.

7. The electrical connector as claimed in claim 1, wherein the solder portions of the terminals are soldered to one end of a flexible printed circuit board on said motherboard.

8. The electrical connector as claimed in claim 7, wherein said housing has a positioning projection located at said rear face thereof for corresponding to a positioning hole at one end of the flexible printed circuit board.

9. An electrical connector for connecting a motherboard to a circuit board, comprising:

a housing having a front face and a rear face, a mounting surface for mounting the housing to a frame, the mounting surface having an indentation for reducing the height of said housing above the frame, a plurality of terminal insertion slots opening in and extending between the front face and the rear face and a blocking portion positioned at an upper edge, near said front face, of the terminal insertion slots, lower edges of the terminal insertion slots form accommodating spaces, said front face of the insulation housing is at an angle to said mounting surface of said insulation housing; and a plurality of terminals, each having a fixing portion, a solder portion connected to one end of the fixing portion and a forwardly extending elastic arm connected to the other end, the elastic arm being connected to a contacting portion, the contacting portion positioned above the accommodating spaces in the insulating housing, said terminals being held in terminal insertion slots in the insulation housing, the solder portion protruding out of the rear face of the insulation housing, an upper surface of the elastic arms of said terminals in engagement with a lower edge of the blocking portions, the elastic arms and the contacting portions of said terminals extending out of the front face of said housing at an angle to said mounting surface of said housing for guiding the circuit board and for slidingly contacting the contacting portion of each of said terminals with each electrical connecting point of said circuit board, respectively.

10. The electrical connector as claimed in claim 9, wherein the blocking portion is a rib transversely positioned at the upper edges of said terminal insertion slots.

11. The electrical connector as claimed in claim 9, wherein the upper edge of each said terminal insertion slots has a position limiting slot mounted at said rear face thereof for holding each said terminal in said housing by the fixing portion.

12. The electrical connector as claimed in claim 11, wherein each of said terminals further has interfering portions mounted at two sides of each the fixing portion for producing an interference fit with the inner walls of the position limiting slot.

13. The electrical connector as claimed in claim 9, wherein the solder portions of said terminals are soldered to one end of a flexible printed circuit board on said motherboard.

14. The electrical connector as claimed in claim 13, wherein said housing has a positioning projection located at said the rear face thereof for corresponding to a positioning hole at one end of the flexible printed circuit board.

* * * * *